US007712731B2

(12) United States Patent
Candiff

(10) Patent No.: US 7,712,731 B2
(45) Date of Patent: May 11, 2010

(54) GUTTER CLAMP

(76) Inventor: Alban J. Candiff, 100 S. Las Flores Dr., Nipomo, CA (US) 93444

( * ) Notice: Subject to any disclaimer, the term of this patent is extended or adjusted under 35 U.S.C. 154(b) by 0 days.

(21) Appl. No.: 11/812,803

(22) Filed: Jun. 21, 2007

(65) Prior Publication Data

US 2008/0029946 A1 Feb. 7, 2008

Related U.S. Application Data

(60) Provisional application No. 60/835,449, filed on Aug. 4, 2006.

(51) Int. Cl.
*B25B 5/14* (2006.01)

(52) U.S. Cl. ..... 269/37; 269/3; 269/6; 269/95

(58) Field of Classification Search ..... 269/6, 269/45, 254 R, 91, 93, 224, 275, 3, 95; 81/90.3, 81/420, 418, 426, 424.5; 294/19.3, 31.1, 294/29, 902; 29/239, 224
See application file for complete search history.

(56) References Cited

U.S. PATENT DOCUMENTS

| | | | | |
|---|---|---|---|---|
| 2,239,468 | A | 4/1941 | Rachlin | |
| 2,431,752 | A * | 12/1947 | Hilstrom | 248/310 |
| 2,686,960 | A | 9/1954 | Le Roy | |
| 2,718,863 | A | 9/1955 | Ertman | |
| 3,202,023 | A | 8/1965 | Parker | |
| 3,498,157 | A * | 3/1970 | McKillip | 76/80 |
| 3,617,044 | A | 11/1971 | Strange | |
| 4,093,202 | A * | 6/1978 | Kincaid | 269/246 |
| D254,563 | S | 3/1980 | Nihizer | |
| 4,386,542 | A | 6/1983 | Verna | |
| 4,564,182 | A | 1/1986 | Svajgl | |
| 4,834,352 | A * | 5/1989 | Thornton | 269/6 |
| 5,050,466 | A | 9/1991 | Cameron | |
| 5,575,518 | A * | 11/1996 | Payne | 294/16 |
| 5,873,568 | A * | 2/1999 | Mayfield | 269/41 |
| 6,175,998 | B1 | 1/2001 | Leo | |
| 6,212,979 | B1 * | 4/2001 | Wang | 81/427.5 |
| 6,367,357 | B1 | 4/2002 | Thomas | |
| D495,225 | S * | 8/2004 | Kurtz | D8/52 |
| 6,772,658 | B1 | 8/2004 | Jasick | |
| D499,320 | S | 12/2004 | Seber et al. | |
| 7,156,004 | B1 * | 1/2007 | Whitehead et al. | 81/420 |
| 7,216,862 | B2 * | 5/2007 | Walsh | 269/6 |

FOREIGN PATENT DOCUMENTS

| | | |
|---|---|---|
| DE | 10118227 | 10/2002 |

* cited by examiner

*Primary Examiner*—Lee D Wilson
(74) *Attorney, Agent, or Firm*—Richard C. Litman

(57) ABSTRACT

The gutter clamp is a handheld clamp allowing a user to temporarily clamp a gutter to a support surface, such as a face board, while work is being performed on the gutter. The gutter clamp includes an handle portion and a clamping portion extending from the handle portion. The clamping portion includes first and second clamping members joined to the handle portion in such a manner that the clamping members pivot toward and away from each other. The first clamping member is adapted for contacting an outer face of the support surface, and the second clamping member has a substantially U-shaped upper end, allowing the upper end to be mounted on an outer wall of the gutter, and to securely contact an inner face of the outer wall, the handles being resiliently biased to hold the clamping members, thus releasably securing the gutter to the support surface.

6 Claims, 5 Drawing Sheets

GUTTER CLAMP

CROSS-REFERENCE TO RELATED APPLICATION

This application claims the benefit of U.S. Provisional Patent Application Ser. No. 60/835,449,filed Aug. 4, 2006.

BACKGROUND OF THE INVENTION

1. Field of the Invention

The present invention relates to clamping devices, and particularly to a gutter clamp allowing a user to temporarily clamp a gutter to a support surface, such as a face board projecting downwardly from a roof, while work is being performed on the gutter.

2. Description of the Related Art

Gutters are typically long, heavy unwieldy pieces of contoured metal, fixed to roofs high off the ground. Thus, when the gutter is being installed on the house or building, or other work is being performed, it is difficult for the workers to hold the gutter against its support surface while performing the necessary work, such as attaching the gutter to the support surface.

A variety of clamping devices have been designed for holding the gutter to the support surface, leaving the hands of the user free to perform the necessary work. Such clamping devices typically include a conventional C-shaped clamp, with one end of the clamp contacting the support surface and the other end holding the outer wall of the gutter. Gutters, however, are typically made of aluminum or similar materials selected for their light weight, and are susceptible to damage in the form of dents, punctures and other force and stress related damage, which can be easily caused by a tight clamp.

Further, metal gutters are generally coated with a corrosion-proof paint or other thin film coating. The contact of a typical C-shaped clamp or similar clamp can cause the paint or coating to be scratched, thus leaving the gutter susceptible to corrosion from exposure to the elements.

Further, such clamps are designed to hold the gutter to the support surface, and do not provide further functionality. It would be desirable to provide a clamp that would allow the user to support the gutter without the need of a separate support surface, leaving the user's other hand free to perform work. It would be further desirable to provide a gutter clamp that does not contact the exterior of the gutter to prevent dents and other damage to the gutter walls. Thus, a gutter clamp solving the aforementioned problems is desired.

SUMMARY OF THE INVENTION

The gutter clamp is a handheld clamp that allows a user to temporarily clamp a gutter to a support surface, such as a face board, while work is being performed on the gutter. Alternatively, the gutter clamp can be used in combination with the gutter alone, allowing the user to securely hold the gutter with one hand, leaving the user with a free hand to perform other work. The gutter clamp includes a handle portion, which may be adjustable, and a clamping portion mounted on the handle portion. The clamping portion includes first and second clamping members, which are joined to the handle portion so that the user may selectively adjust the width between the clamping members and releasably lock them into position.

The handle portion includes a pair of handle members, which are pivotally secured to one another. The first and second handle members are further resiliently biased with respect to one another through a spring or other suitable resilient element, and in one embodiment, may be releasably locked together in a desired position.

The first clamping member is adapted for contacting an outer face of the support surface, and the second clamping member has a substantially U-shaped upper end, allowing the upper end to be mounted on an outer wall of the gutter, and to securely contact an inner face of the outer wall, thus releasably securing the gutter to the support surface.

In use, the gutter is positioned against one face of the support surface. The upper end of the first clamping member is positioned to contact the opposed face of the support surface. The width between the first and second clamping members is adjusted by the user via the pivoting handle members so that the upper U-shaped contour of the second clamping member can fit over the outer wall of the gutter, allowing the terminal end of the second clamping member to make contact with the inner face of the outer wall.

In one embodiment, an adjustment mechanism is mounted on the terminal end of the second clamping member. The adjustment mechanism may be selectively tightened to ensure secure contact between the gutter clamp and the gutter. The adjustment mechanism may be a threaded bolt or the like engaging a threaded ring or other mount formed on the end of the second clamping member.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
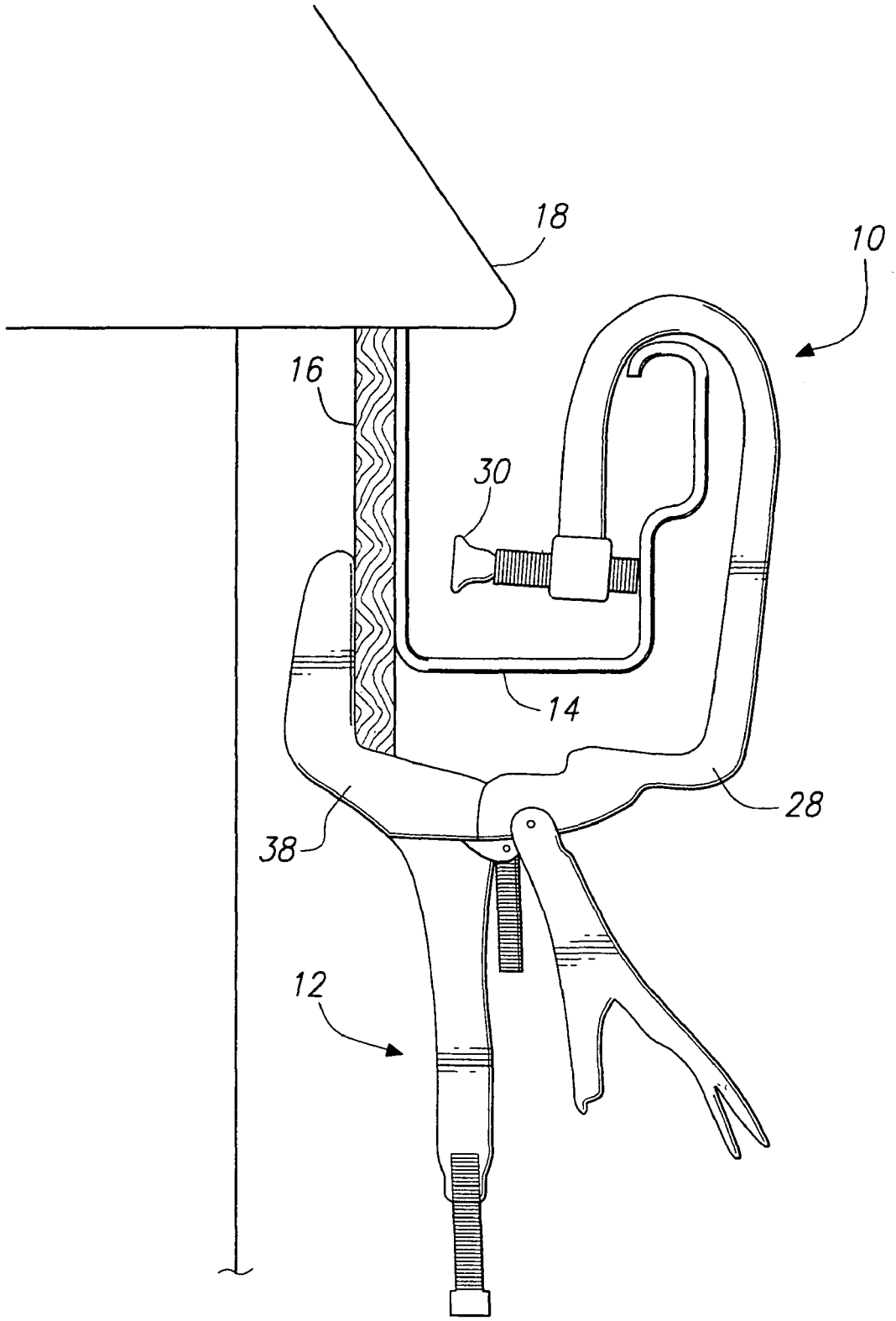
FIG. 1 is an environmental, perspective view of a gutter clamp according to the present invention.
Figure 2:
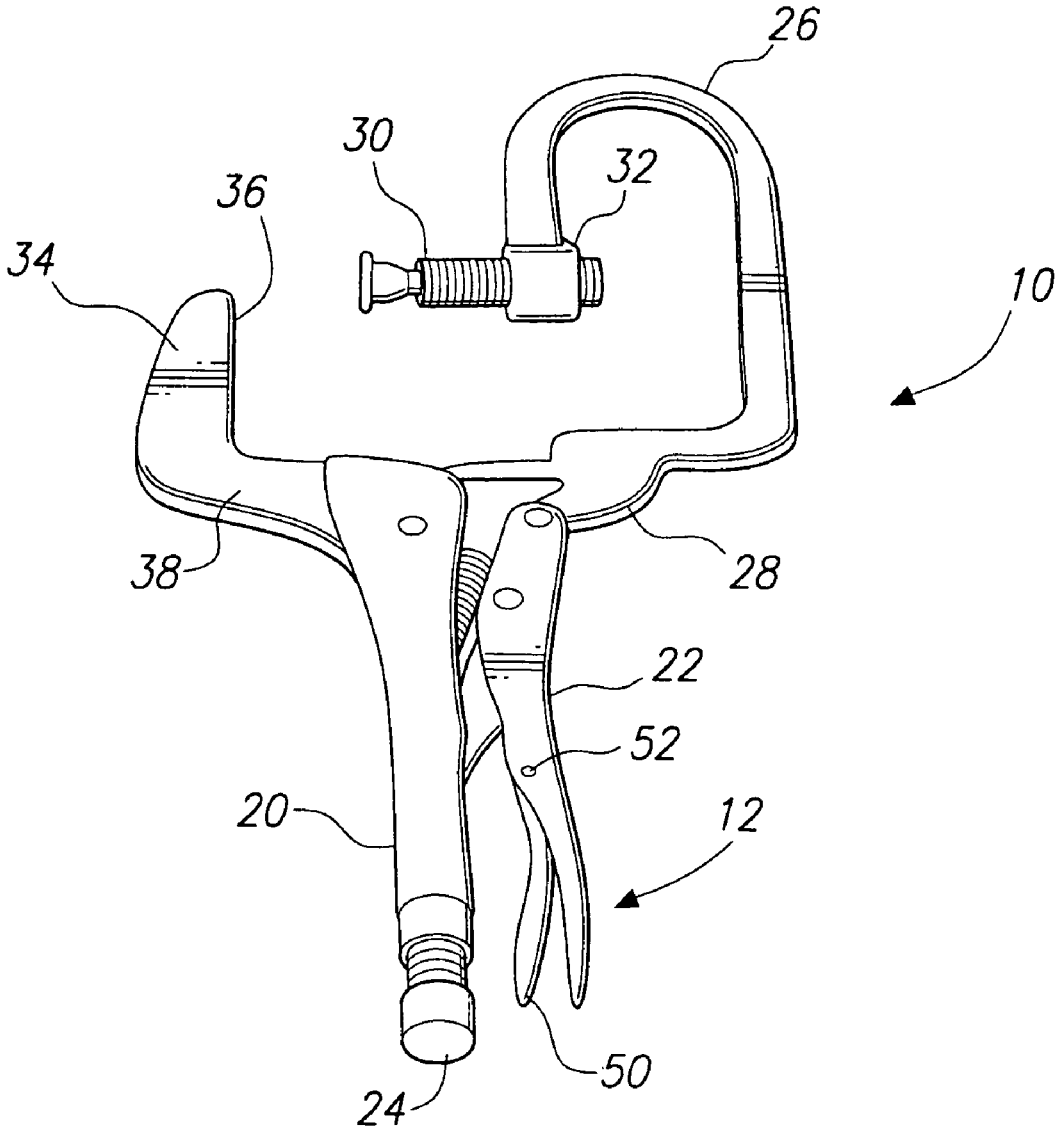
FIG. 2 is a perspective view of the gutter clamp according to the present invention.
Figure 3:
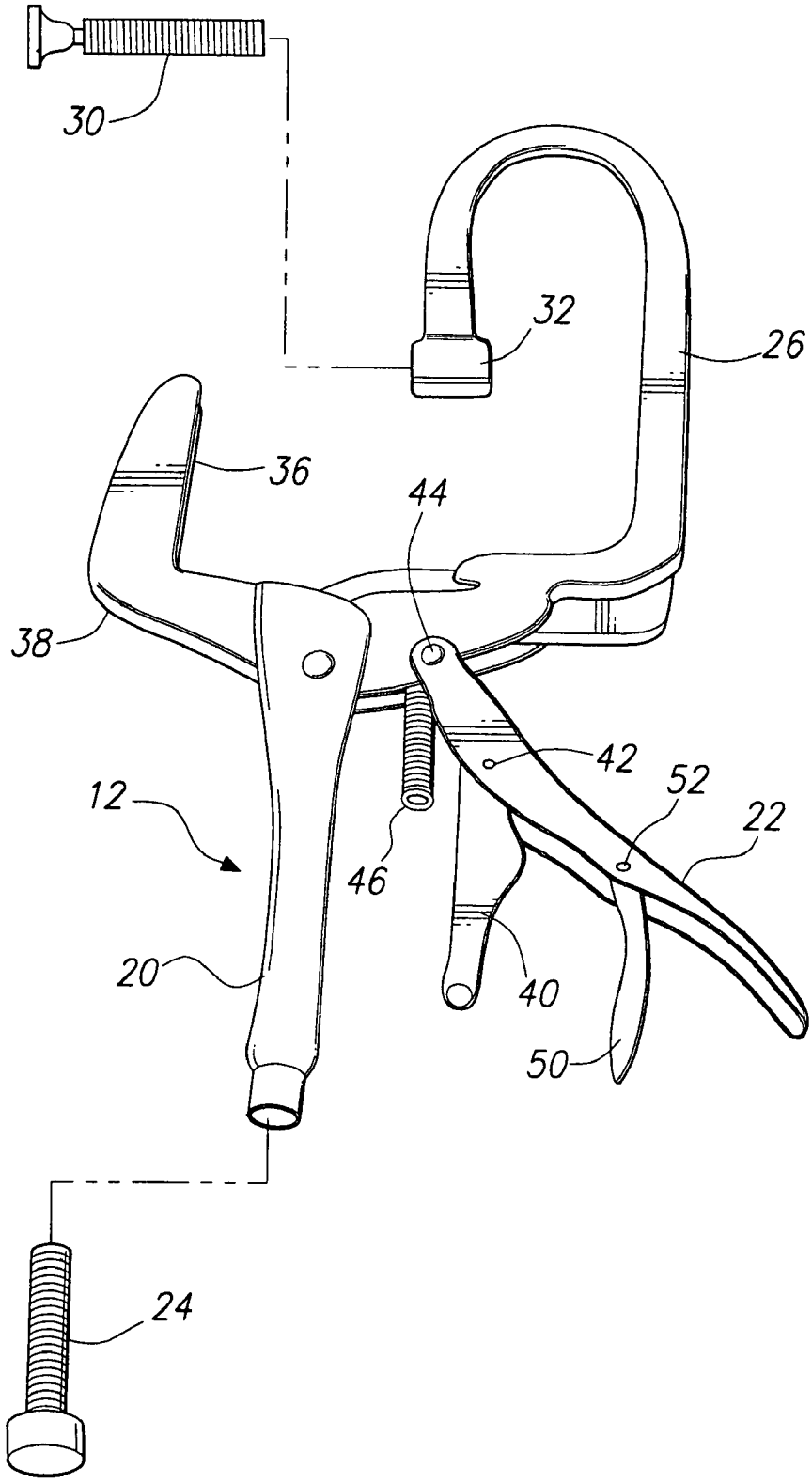
FIG. 3 is a partially exploded perspective view of the gutter clamp according to the present invention.

Referring now to the FIGS. 1-3, the gutter clamp 10 is a handheld clamp that allows a user to temporarily clamp a gutter to a support surface, such as a face board, while work is being performed on the gutter. In FIG. 1, gutter clamp 10 is shown as clamping gutter 14 to a face board 16, which projects downwardly from roof 18. It should be understood that the gutter clamp 10 may be used to clamp gutter 14 to any suitable surface, depending upon the type of edifice, the materials available and the nature of the work being performed. Alternatively, the gutter clamp 10 can be used in combination with the gutter 14 alone, allowing the user to securely hold the gutter with one hand, leaving the user with a free hand to perform other work.

As best shown in FIG. 2, the gutter clamp 10 includes an adjustable handle portion 12 and a clamping portion formed from first and second clamping members 38, 28, respectively. Clamping members 38, 28 are mounted on the handle portion 12 in such a manner that clamping members 38, 28 pivot with respect to one another as the handle members 20 and 22 pivot towards and away from each other.

The adjustable handle portion 12 is formed from a first handle member 20 and a second handle member 22. First and second handle members 20, 22 act as an adjustable, releasably locking toggle to adjust the width between first and second clamping members 38, 28, and to selectively and releasably lock members 38, 28 in place with respect to one another. As best shown in FIG. 3, toggle member 40 is pivotally joined to second handle member 22 by a pivotal connection, such as a pivot pin, 42.

As best shown in FIG. 2, toggle member 40 extends into a recess formed in first handle member 20, where its position may be selectively adjusted by the user through adjustment of adjustment mechanism 24. Adjustment mechanism 24 may be a threaded bolt or the like, which is received within a threaded bore hole formed through first handle member 20. Spring element 46 is connected between clamping member 28 and handle 20 in order to bias clamping member 28 to a normally outward position. An operating lever 50 is pivotally connected, as by a rivet 52 or the like, adjacent to the end of handle 22. In FIGS. 1-3, the handle portion of gutter clamp 10 is shown as being a vise grip locking type handle. It should be understood that any suitable handle allowing for pivoting of the clamping portion to adjust to the gutter may be used. As will be described in further detail below, with regard to the embodiments of FIGS. 4 and 5, the handle portion may be formed as a spring clamp-type handle, for example.

The first clamping member 38 includes an upper portion having a substantially linear inner face 36, which is adapted for contacting an outer face of support surface 16, as shown in FIG. 1. The second clamping member 28 has a substantially U-shaped upper end 26, allowing the upper end to be mounted on an outer wall of the gutter 14, and further to allow secure contact with an inner face of the outer wall of gutter 14.

As shown, upper end 26 of second clamping member 28 terminates in a threaded ring 32 for receiving adjustment rod 30, which may be a threaded bolt or the like. As shown in FIG. 1, adjustment rod 30 is selectively tightened to make contact with the inner surface of the outer wall of gutter 14.

In use, the gutter 14 is positioned against one face of the support surface 16. The upper end 34 of the first clamping member 38 is positioned so that linearly contoured face 36 contacts the opposed face of the support surface 16. The width between the first and second clamping members 38, 28 is adjusted by the user by pivoting the handle members 20, 22 so that the upper U-shaped end 26 of the second clamping member 28 can fit over the outer wall of the gutter, tightening the adjustment rod 30 to make contact with the inner face of the outer wall. The toggling adjustable handle 12 can be locked in place to form a securely locked clamp for maintaining the gutter 14 in position on surface 16.

Alternatively, the gutter clamp 10 could be used with gutter 14 alone, with the face 36 of upper end 34 making contact with the opposite wall of gutter 14, rather than a support surface 16. This would allow the user to grasp and support the gutter 14 with one hand, while leaving the user's other hand free.

Figure 4:
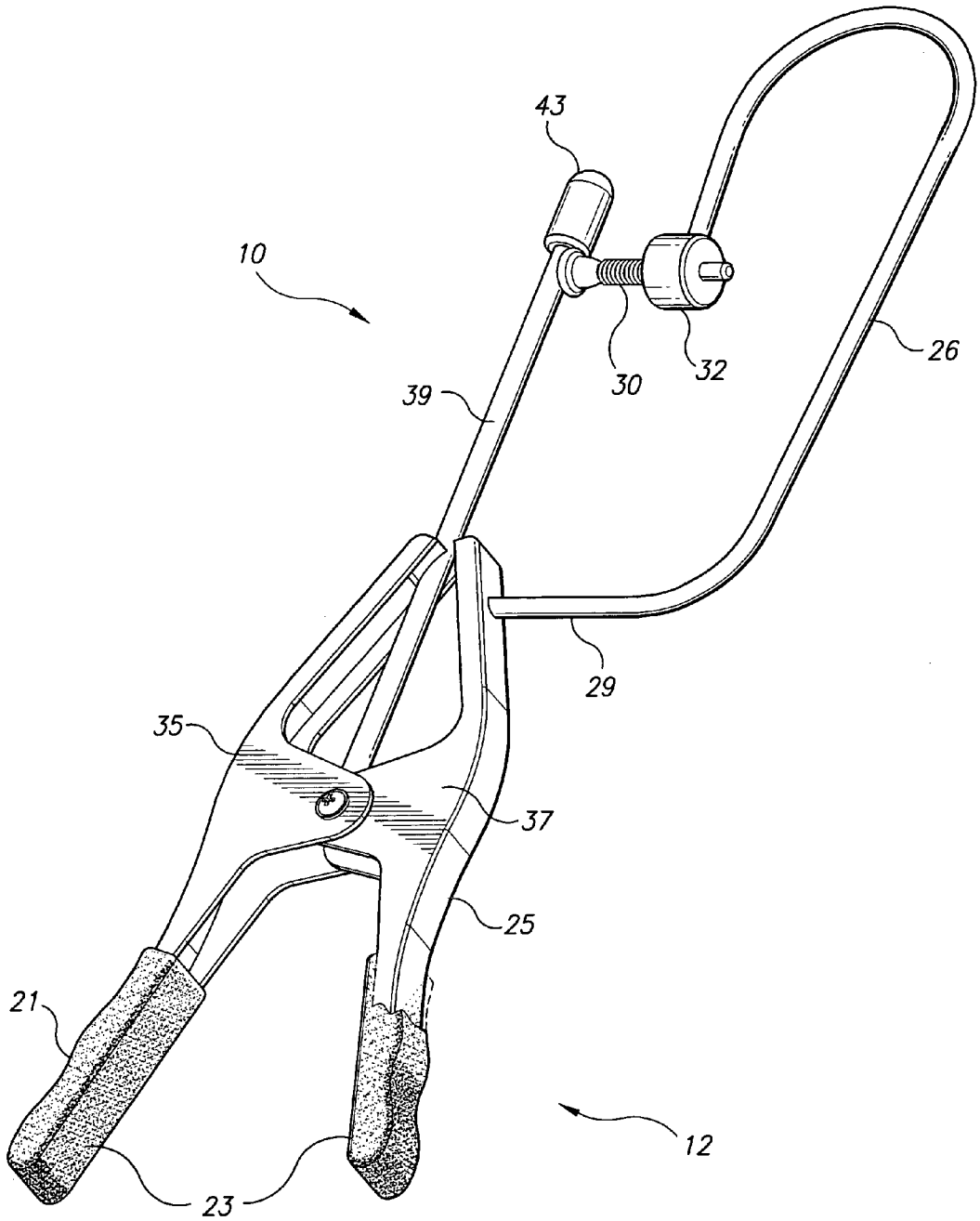
FIG. 4 is a perspective view of an alternative embodiment of a gutter clamp according to the present invention.
Figure 5:
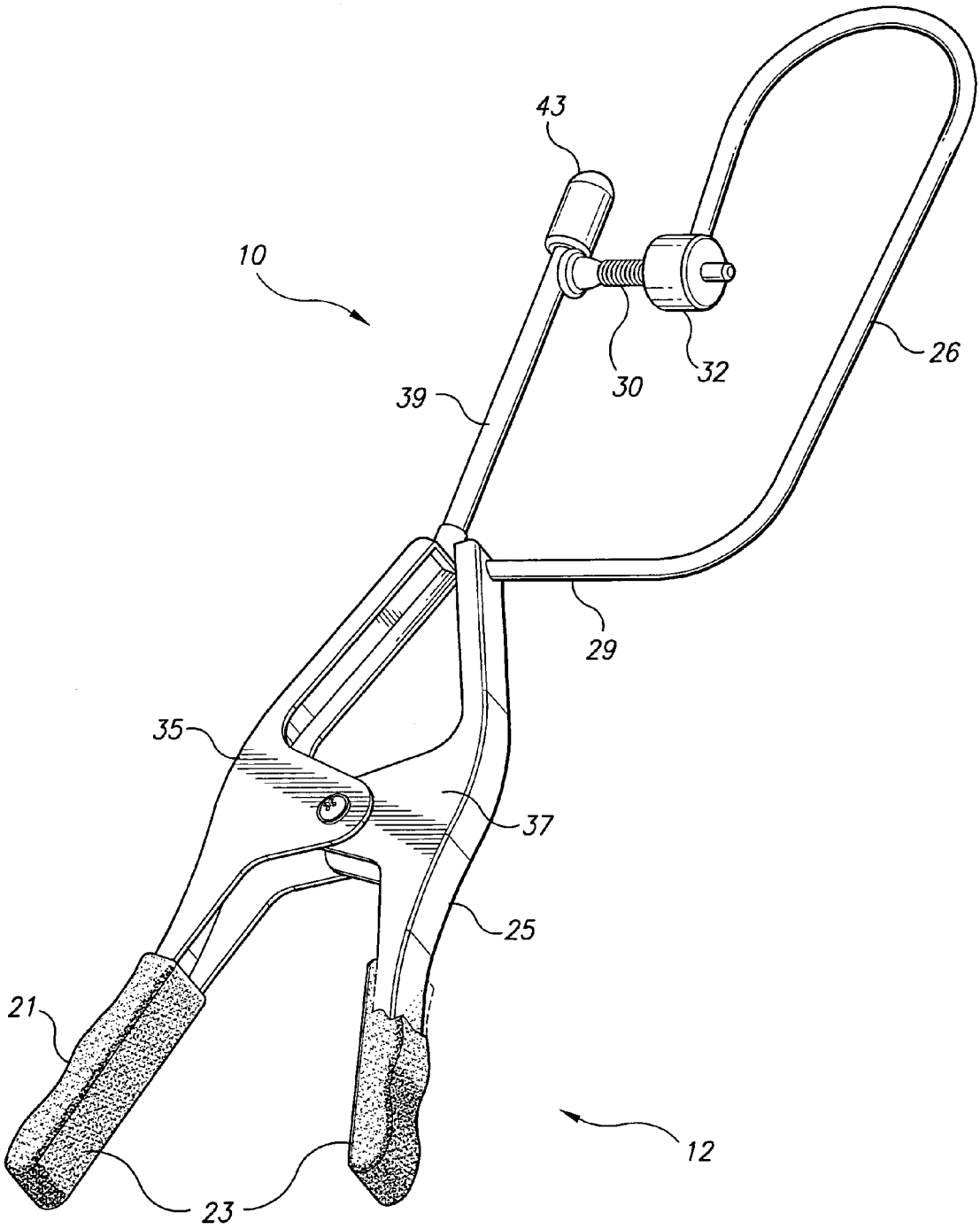
FIG. 5 is a perspective view of another alternative embodiment of a gutter clamp according to the present invention.

In the alternative embodiment shown in FIG. 4, first and second clamping members 38, 28, respectively, are replaced by first and second clamping members 39, 29, respectively. Clamping members 39, 29 have a substantially cylindrical or round bar shape, i.e., clamping members 39,29 each have a substantially circular cross-sectional contour.

In the embodiment of FIG. 4, a cap member 43 may be mounted on an upper end of first clamping member 39 for the prevention of injury or damage to the user or to the surface to which clamp 10 is applied. Cap 43 may be formed from rubber or the like. Further, in the embodiment of FIG. 4, the locking handle members 20, 22 of FIGS. 1-3 are replaced a spring clamp having first and second handle members 21, 25 connected by a pivot pin having a torsion spring concentrically disposed around the pivot pin to bias the upper ends of handle members 21, 25 closed or towards each other.

Clamp member 39 is straight, and is fixed to the upper end of handle member 21, being adapted for insertion behind the fascia from below. Clamp member 29 is fixed to the upper end of handle member 25, and has a first portion extending normal to clamp member 39, and a second portion 26 extending parallel to and farther than clamp member 39, terminating in a hook having an end slightly below the free end of clamp member 39. A socket 32 having an internally threaded bore is fixed to the end of the hook, and an adjustment screw 30 having a bearing face at the end thereof is threaded into the socket 32.

In use, the lower ends of handle members 21, 25 are squeezed together against the bias of the torsion spring to spread the upper ends of the handle members 21,25 apart, thus separating clamp members 39, 29. The straight clamp member 39 is placed behind the fascia, the hook member extending into the channel defined by the gutter. The handle members 21,25 are released, the torsion spring resiliently biasing the upper ends towards each other, the bearing face of adjustment screw 30 bearing against the inner wall of the gutter in order to clamp the gutter against the fascia until the gutter can be nailed in place, or against clamping member 39 if the clamp is used to hold or carry the gutter alone.

Handle members 21,25 may have plastic grips 23 having contours adapted for accommodating the fingers defined therein disposed over the lower ends of the handle members 21,25. Clamp members 39,29 are preferably made from round bar stock, and may have soft plastic sleeves disposed over the portions of members 39,29 that may come into contact with the gutter in order to avoid marring the finish on the surface of the gutter or fascia.

It should be understood that the particular contouring and joining of elements of gutter clamp 10 may be altered, as design choice, without departing from the spirit or scope of the invention. For example, in the embodiment of FIG. 5, clamping member 39 is joined directly to the upper end of handle portion 35 and, similarly, clamping member 29 is joined to the upper end of handle portion 37. The function of the gutter clamp 10, however, remains the same as that described above with regard to the embodiment of FIG. 4. It should be understood that the particular size and contouring of the gutter clamp 10, and of the elements forming the gutter clamp 10, may be varied without departing from the teachings of the present invention.

It is to be understood that the present invention is not limited to the embodiment described above, but encompasses any and all embodiments within the scope of the following claims.

I claim:

1. A gutter clamp, comprising:

a first handle member and a second handle member, each said handle member having an upper end and a lower end, said first handle member being pivotally connected to said second handle member;

a first clamping member extending upward from the upper end of said first handle member, said first clamping member including a linear component terminating into a free end adapted for placement behind a supporting surface for a gutter;

a second clamping member affixed to the upper end of said second handle member, said second clamping including a first section extending substantially normal to said first clamping member, a second section extending substantially parallel to said first clamping member and terminating into a U-shaped hook having a free end adapted for hooking into a channel defined by the gutter;

a threaded socket affixed to the free end of the U-shaped hook;

an adjustment screw extending from said threaded socket, the adjustment screw being movable towards and away from the first clamping member; and means for resiliently biasing said first clamping member towards and said second clamping member in order to clamp the gutter channel to the supporting surface for the gutter, the supporting surface and one wall of the gutter being clamped between the first clamping member and the adjustment screw.

2. The gutter clamp according to claim 1, further comprising a pivot pin connecting said first handle member to said second handle member, said resilient bias means comprising a torsion spring concentrically disposed around the pivot pin and bearing against the handle members.

3. The gutter clamp according to claim 1, wherein said first clamping member and said second clamping member are made from round bar stock.

4. The gutter clamp according to claim 3, further comprising plastic sleeves disposed over portions of said first clamping member and said second clamping member for protecting surface finishes of the gutter and the supporting surface.

5. The gutter clamp according to claim 1, further comprising a cap disposed on the free end of said first clamping member.

6. The gutter clamp according to claim 1, further comprising grips having contours adapted for accommodating fingers, the grips being disposed on each said handle member.

* * * * *